US005683006A

United States Patent [19]

Cook, III

[11] Patent Number: 5,683,006

[45] Date of Patent: Nov. 4, 1997

[54] LID FOR BEVERAGE CONTAINER

[76] Inventor: Walter M. Cook, III, 1940 Olive St., Oshkosh, Wis. 54904

[21] Appl. No.: 601,174

[22] Filed: Feb. 14, 1996

[51] Int. Cl.[6] ..... B65D 17/34

[52] U.S. Cl. ..... 220/269; 220/906; D9/438

[58] Field of Search ..... 220/269, 270, 220/906, 265; D9/516, 518, 523, 537, 549, 449, 447, 438

[56] References Cited

U.S. PATENT DOCUMENTS

| | | | |
|---|---|---|---|
| D. 338,156 | 8/1993 | Cook | D9/438 |
| D. 364,807 | 12/1995 | Taylor | D9/438 |
| D. 365,274 | 12/1995 | Cook | D9/438 |
| D. 365,988 | 1/1996 | Clarke, III | D9/438 |
| D. 371,073 | 6/1996 | Taylor | D9/438 |
| 4,564,119 | 1/1986 | Tsuge et al. | 220/270 |
| 4,913,305 | 4/1990 | Hanafusa et al. | 220/269 |
| 5,405,039 | 4/1995 | Komura | 220/269 |
| 5,555,992 | 9/1996 | Sedgeley | 220/906 X |

FOREIGN PATENT DOCUMENTS

| | | | |
|---|---|---|---|
| 372419 | 6/1990 | European Pat. Off. | 220/270 |

*Primary Examiner*—Allan N. Shoap
*Assistant Examiner*—Nathan Newhouse
*Attorney, Agent, or Firm*—R. Jonathan Peters

[57] ABSTRACT

A lid for a beverage container having a lifting tab is affixed to the lid by a staking member or rivet which serves as a fulcrum about which the tab pivots. The staking member is disposed radially from the center of the lid. A line of weakness defining a rupturable area in the lid is formed between the staking member and the periphery of the container, and defines a fruto-conical configuration so as to subtend an angle of at least about 90°. The line of weakness is nearly completely continuous, but has one relatively small broken zone whereby the severed area circumscribed by the line is retained by the lid at the broken zone when the area is ruptured to create a hole along the line. The staking member is disposed radially from the center of the lid by at least about 2.5 mm., and the remaining surface area of the lid outside the rupturable surface area defined the line of weakness is greater than if a staking member were disposed in the center of the lid.

7 Claims, 2 Drawing Sheets

LID FOR BEVERAGE CONTAINER

FIELD OF THE INVENTION

This invention relates to a lid for a beverage can. In its more specific aspect, this invention relates to a lid for a beverage can having an enlarged area of opening with respect to the total area of the lid.

BACKGROUND AND PRIOR ART

Beverage cans or containers for storing and dispensing a beverage, such as beer, carbonated soda, fruit juices, and the like, are convenient and in extensive use. A lifting tab or pull tab is attached to the container lid, and an area or section of the lid defined by a score line is rupturable along this score line so as to be partially severed or removed, or entirely removed, from the lid when the tab is pulled upwardly by the consummer. The rupturable area defining the opening in the lid must form a large enough hole or opening so as to admit air for venting when the liquid is dispensed. The beverage then can be drunk or poured from the container.

A conventional beverage container, such as for containing a carbonated beverage, is shown in FIGS. 1 and 2, which is a very popular type and in wide use for beverages. The can 10 having a circular lid 12 sealed to a cylindrical body at one end is provided with a scoreline 14, or line of weakness, for defining a severable area 16 to provide for an opening 18. A tab 20, sometimes referred to as a lifting tab or pull tab, is affixed to the lid by a rivet or staking member 22. The tab 20 has a lifting section 24 manipulable by the finger of the consumer, and a pressure-applying section 26, and the staking member serves as a fulcrum about which the tab may be turned or pivoted. Thus, when the lifting section is raised or pulled upwardly, the pressure section applies a downward pressure against the severable area or panel portion, thereby rupturing the severable area and providing an opening 18 in that area, as shown in FIG. 2. The scoreline defining the severable area or panel portion may be broken or discontinuous, typically under the pressure-applying section of the tab, so that this area is partially ruptured or severed from the lid but the panel is retained by the lid by a very small hinge-like member 28.

The conventional type of container lid in which the severable panel is held by the lid after being opened is distinct from the pull-top lid wherein the entire area circumcribed by the scoreline, including the tab, is removed from the can lid. The tab is typically provided with a sharp tip that abuts or rests on the score line, and when the tab is pivoted, the tip penetrates the score line. The tab then is lifted or pulled upwardly at the finger-grip end so as to tear the severable panel section completely from the lid.

The problem with the conventional small tear-drop opening or small elliptical opening formed in the lid is that the beverage either pours too slowly from the can, or there is not a smooth fluid flow of the beverage, or the beverage can be drunk in small increments only. Solutions to these problems, and other problems associated with can lids and the opening means for the lids, are disclosed in numerous patents. For example, beverage containers of these known typical configurations showing wholly and partially removable panel sections of the lid, and providing solutions to various problems associated with can lids, are disclosed in U.S. Pat. Nos. 4,258,859, 4,913,305, 4,564,119, and 5,405,039.

Thus, a large opening in the lid is shown in U.S. Pat. No. 4,913,305, wherein one-half of the entire lid is partially removable, thereby providing an unrestricted dispensing flow rate. As shown in this reference, the lid 11 is bifurcated by a demarcation line 12, and a scored line 28 adjacent the periphery extends to the demarcation line. A pull tab 14 having a tip 29 resting on the scored line pivots downwardly about rivet 36, thereby puncturing the scored line, and the lid then can be pulled open along the scored line to the line of demarcation. In this manner, approximately one-half of the lid is opened to access the beverage, and the severable panel, which is partially removable, is folded back along the demarcation line and seated under the peripheral protuberances 42.

Similarly, U.S. Pat. No. 4,258,859 shows a severable panel portion 4a that is nearly the complete area of the lid (see FIGS. 1 and 2 of that patent). The tab 14 is arranged adjacent the periphery of the can and has a sharp puncuturing edge 14a abutting the circular scoreline 10. When the score line is puncutured, the top lid or panel is then removed patially or completely from the lid. In accordance with an alternative embodiment shown in FIG. 8 of this patent, there is disclosed a completely removable pull-top lid or panel that has a smaller area than the lid (about one-third the surface area of the lid).

Also, U.S. Pat. No. 4,564,119 discloses a completely removable panel section from the lid.

In U.S. Pat. No. 5,405,039, the tab 6 is staked at the central portion of the lid with a staking member or rivet 7, and a line of weakness 8 is formed along the periphery of the lid 3. In the embodiment shown in FIGS. 1–3, the opening is large, ranging from a 90° segment of a circle to a semicircle. In FIG. 4 of the patent, which discloses a pull-tab lid, the score line 10 extends radially and to the rear of the staking member so as to define a large rupturable area that is separated competely from the remainder of the lid. A center stake or rivet, however, as shown in this reference, requires high stress on the opening panel portion in order to rupture the lid, which is particularly true with an opening of increased area. Also, staking the pull tab in the center of the lid decreases the remaining area of the lid.

This invention has therefore as its purpose to provide a lid for a beverage can with a large opening that overcomes the disadvantages of the prior art.

It is another object of the invention to provide for an opening for a container lid that is relatively large, wherein the fulcrum for the pull-tab is disposed off-center or eccentrically relative to the circular periphery of the lid.

It is still another object of the invention to provide for such a lid having a relatively large opening without diminishing the remaining area of the lid, which would be expected with an enlarged opening and a tab having a center-disposed fulcrum.

SUMMARY OF THE INVENTION

In accordance with the invention, a cylindrical container for holding and dispensing a beverage has a substantially circular lid hermetically sealed to the cylindrical body at one end thereof. A tab having a lifting section and a pressure-applying section is affixed to the lid by a staking member or rivet which serves as a fulcrum about which the tab turns or is pivoted. It is critical that the fulcrum (i.e., staking member) is disposed radially from the center of the lid, that is a circle formed with the fulcrum being the center is eccentric relative to the circle of the lid, as explained in greater detail hereinbelow. A line of weakness defining a rupturable area in the lid is formed between the staking member and the periphery of the container. This line of weakness comprises first and second score lines diverging radially to spaced-apart points adjacent the periphery of the lid subtending an angle of at least about 90°. In a prefered embodiment of the invention, the first and second score lines are arcuate when viewed in plan. A third score line is formed along the periphery of the lid between the spaced points, and a fourth score line is formed adjacent the staking member, passing at least partially beneath the pressure-applying section of the tab, and substantially concentric with the third score line. The first and second score lines intersect or about terminate at the fourth score line, thereby defining a rupturable surface area of a substantially truncated-conical configuration. The line of weakness is nearly completely continuous, but has at least one relatively small broken zone, preferably proximate or in the vicinity of the pressure-applying section of the tab, whereby the severed area circumscribed by the score line is retained by the lid at the broken zone when the area is ruptured. It will be observed that because the staking member is disposed radially from the center of the lid by at least about 2.5 millimeters and on a radius substantially normal to a chord extending between the spaced points on the periphery, the remaining surface area of the lid outside the rupturable surface area defined the score lines is greater than if a staking member were disposed in the center of said lid.

DETAILED DESCRIPTION OF THE INVENTION

Figure 1:
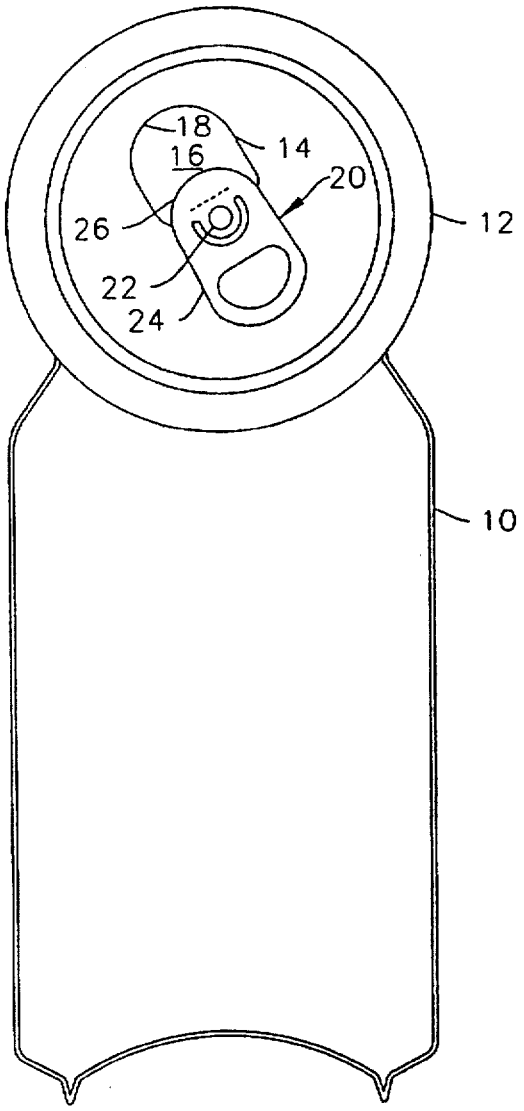
PRIOR ART FIGURE 1
FIG. 1 is a perspective view showing a prior art lid for a beverage container.
Figure 2:
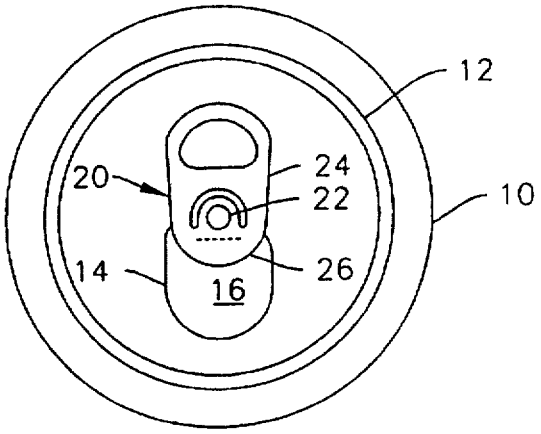
FIG. 2 is a plan view showing the open state of the can of FIG. 1.
Figure 3:
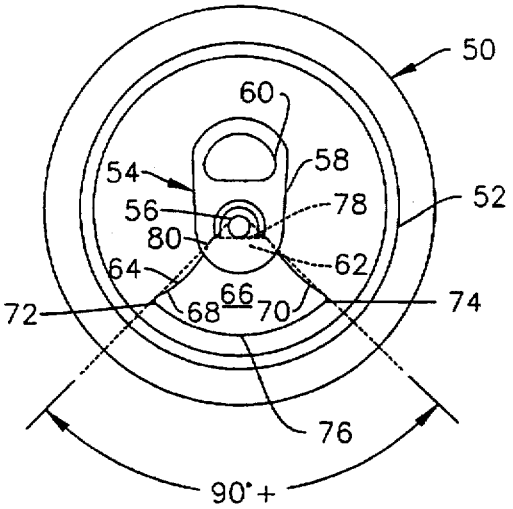
FIG. 3 is a plan view of a can lid for a beverage container and made in accordance with the present invention.
Figure 4:
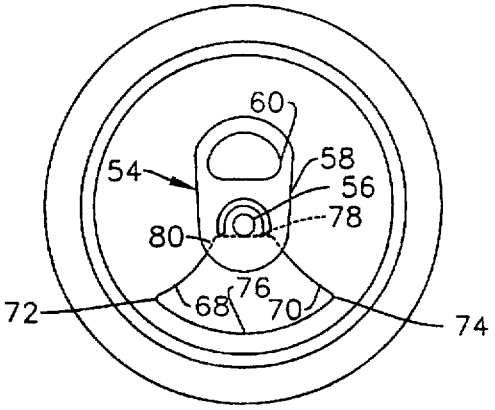
FIG. 4 is a view similar to FIG. 3, but showing the pull tab in phantom so as to show a broken score line.

Referring to the drawings wherein like reference numerals refer to similar parts throughout the various views, there is illustrated in FIGS. 3 and 4 a cylindrical container, indicated generally by the numeral 50, for storing and dispensing a liquid such as a carbonated drink, and is hermetically sealed at both the top and bottom ends. The container or can, typically fabricated of an aluminum alloy, is provided with a lid 52 sealed at one end or the top end of the can. It will be observed that the top and bottom ends are smaller in diameter than the cylindrical body, because heavier gauge metal is required for the ends, and a smaller diameter saves metal. In a typical can such as for beer or soda, the diameter of the top lid is about 50–52 millimeters (about two inches).

A lifting tab or opening tab 54 is attached to the lid 52 by means of a staking member or rivet 56. The tab 54 includes a lifting section 58 having a small hole 60 for accommodating a finger and disposed to one side of the rivet 56, and a pressure-applying section 62 disposed to the opposite side of the rivet. It will be observed that the staking member is placed off-center, as explained below in greater detail. Further, in this manner, the rivet or staking member serves as a fulcrum or pivot point for the tab. Thus, when the lifting section 58 is raised by the finger of the consummer, the opposite section 62 is pivoted downwardly and brought into contact with the lid and consequently applies pressure to that area of the lid.

Figure 5:
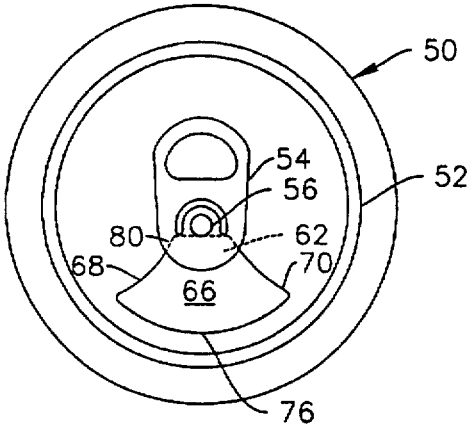
FIG. 5 is a plan view showing the can lid of FIG. 3 in an open state.
Figure 6:
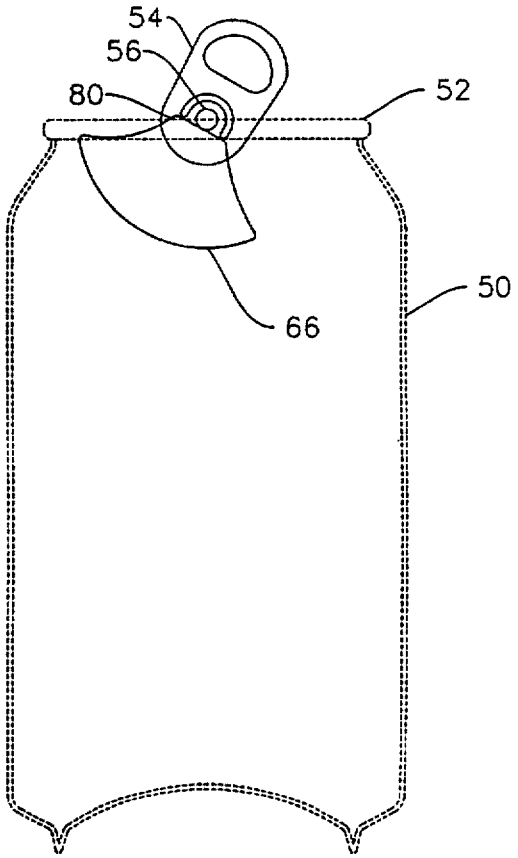
FIG. 6 is a fragmentary sectional view showing the lid in an open state.

The lid 52 is provided with a nearly continuous line of weakness 64, which defines a rupturable area or panel 66 in the lid. The formation of a line of weakness on a can cover or lid is well known and can be accomplished by any conventional means such as pressing. As best shown in FIGS. 4 and 5, the substantially continuous line of weakness comprises first and second score lines 68 and 70 diverging radially to spaced-apart points 72 and 74, respectively, adjacent the periphery of the lid. The score lines 68 and 70, if drawn from the center of the circular lid to the points 72 and 74, subtend an angle "A" of least about 90°, and preferably about 90°–135°. This angle is significant because the opening formed in the lid is relatively wide, especially much wider than with a conventional beverage can, as will be more apparent from the additional description. For that reason, an angle of at least about 90° is important to provide for the wide opening, but there is usually no need to exceed more than about 135°. A third score line 76 is formed along the periphery between the spaced-apart points 72 and 74. The line of weakness is completed by a fourth score line 78 formed adjacent the staking member, which is substantially concentric with the third score line, and runs beneath the pressure-applying section 62 of the tab 54 and junctures or intersects with the first and second score lines. That is, the first and second score lines about terminate at the fourth score line.

Although the line of weakness formed is described as or referred to as nearly continuous or substantially continuous, it will be observed from FIG. 5 that this line is broken at 80, preferably at one location or zone proximate the tab, and it is so understood that this is the meaning of the term as used herein and in the appended claims. The reason for the break 80 in the line 64 is to provide a hinge 80 (see FIGS. 3 and 5), so that when the lid is ruptured, the severed panel is retained or hangs by the lid rather than falling free and thereby creating a hazard or a nuisance. Hence, the rupturable panel section circumscribed by the line of weakness is sometimes referred to as a partially removable lid, which is in contrast to a completely removable lid.

It thus will be observed that the line of weakness 64 formed in the lid defines a rupturable surface area having a substantially truncated-conical configuration. This configuration is advantageous in that it provides for a wide opening at the periphery or base of the pouring spout formed, but not too wide at the opposite end which can cause spilling especially if one were to drink directly from the can. Also, in a preferred embodiment, the score lines 68 and 70 are arcuate, preferably defining a concave rupturable surface area along the perimeter of the first and second score lines. Here, too, the arcuate score lines are advantageous in that the opening is widened toward the base or periphery of the lid. In a conventional lid in extensive use, the opening at its widest dimension is about 17 to 18 millimeters, and in contrast my invention provides for an opening at its widest dimension of about 35 to 40 millimeters. As a result, a lid made in accordance with my invention provides for faster and easier pouring or drinking from the can.

As stated above, the staking member or rivet 56 is positioned off-center. Thus, the staking member is disposed on a radius that is substantially normal to a chord drawn between the two points 72 and 74 at or near the periphery, and the staking member is at least about 2.5 to about 4 millimeters, and preferably about 3 to 3.25 millimeters, from the center of the lid. Thus, the staking member is disposed eccentrically relative to the periphery of the lid, that is, a circle formed with the rivet being the center is eccentric relative to the circle of the lid. This off-center positioning of the rivet is advantageous in that stress by the tab on the rupturable area is relieved or decreased. In contrast, a center stake as shown in the prior art and in conventional use results in a high stress on the opening panel portion or rupturable portion of the lid, which is even more critical with a larger opening, and on occasion the tab pulls loose from the lid. In addition, the tab for any lid is standard size, and when the staking member is off-center, the tab is positioned off-center, whereby the remaining surface area of the lid outside the rupturable surface area defined by the line of weakness is greater than if a staking member were disposed in the center of the lid. This feature is particularly advantageous in that it provides for a larger area of the lid on which to provide printed matter or other art work.

It will be observed that by reason of my invention numerous advantages are achieved in providing a lid for a beverage can having a relatively large rupturable area and the staking member disposed off-center. Further, it should be understood that the foregoing detailed description has been given for clearness of understanding only, and no unnecessary limitations should be understood therefrom, as modifications will be obvious to those skilled in the art.

What is claimed is:

1. In a beverage container comprising a substantially cylindrical body for storing and dispensing a beverage, a substantially circular lid sealed to said cylindrical body at one end thereof, a tab having a lifting section and a pressure-applying section, a staking member staking said tab to said lid and serving as a fulcrum about which the tab pivots, a score line defining a rupturable area in said lid disposed between said staking member and the periphery of said container, the improvement comprising: a substantially continuous line of weakness having a broken zone proximate said tab, and comprised of first and second score lines diverging radially to spaced-apart points adjacent the periphery of said lid and subtending an angle of at least about 90°, a third score line along the periphery of said lid between said points, and a fourth score line adjacent the staking member and substantially concentric with said third score line, said fourth score line juncturing with said first and second score lines and extending at least partially beneath said pressure-applying section of said tab, thereby defining a rupturable surface area on said lid of a substantially truncated-conical configuration, said staking member disposed radially from the center of said lid by at least about 2.5 millimeters and on a radius substantially normal to a chord extending between said points, whereby the remaining surface area of the lid outside the rupturable surface area defined by the line of weakness is greater than if a staking member were disposed in the center of said lid.

2. In a beverage container according to claim 1 wherein said first and second score lines are arcuate when viewed in plan.

3. In a beverage container according to claim 2 wherein said first and second score lines define a concave rupturable surface area along the perimeter of said first and second score lines.

4. In a beverage container according to claim 2 wherein said staking member is disposed radially from the center of the lid by about 2.5 to 4 millimeters.

5. In a beverage container according to claim 1 wherein said broken zone is at the juncture of said first and fourth score lines.

6. In a beverage container according to claim 1 wherein said staking member is disposed radially from the center of the lid by about 2.5 to 4 millimeters.

7. In a beverage container according to claim 1 wherein said staking member is disposed radially from the center of the lid by about 3 to 3.25 millimeters.

* * * * *